US007645728B2

(12) United States Patent
Esche, Jr. et al.

(10) Patent No.: US 7,645,728 B2
(45) Date of Patent: Jan. 12, 2010

(54) LUBRICANT AND FUEL ADDITIVES DERIVED FROM TREATED AMINES

(75) Inventors: Carl K. Esche, Jr., Richmond, VA (US); John T. Loper, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 881 days.

(21) Appl. No.: 10/779,970

(22) Filed: Feb. 17, 2004

(65) Prior Publication Data

US 2005/0181959 A1 Aug. 18, 2005

(51) Int. Cl.
*C10M 159/16* (2006.01)
*C10M 133/56* (2006.01)

(52) U.S. Cl. ..... 508/542; 508/291

(58) Field of Classification Search ..... 508/291, 508/542

See application file for complete search history.

(56) References Cited

U.S. PATENT DOCUMENTS

| | | | |
|---|---|---|---|
| 2,459,112 | A | 1/1949 | Oberright |
| 2,749,311 | A | 6/1956 | Sabol |
| 2,760,933 | A | 8/1956 | Fields |
| 2,765,289 | A | 10/1956 | Fields |
| 2,850,453 | A | 9/1958 | Fields |
| 2,910,439 | A | 10/1959 | Fields |
| 2,962,442 | A | 11/1960 | Andress |
| 2,984,550 | A | 5/1961 | Chamot |
| 3,036,003 | A | 5/1962 | Verdol |
| 3,166,516 | A | 1/1965 | Kirkpatrick |
| 3,172,892 | A | 3/1965 | LeSuer |
| 3,219,666 | A | 11/1965 | Norman |
| 3,235,498 | A | 2/1966 | Waldmann |
| 3,235,499 | A | 2/1966 | Waldmann |
| 3,235,502 | A | 2/1966 | Waldmann |
| 3,236,770 | A | 2/1966 | Matson |
| 3,272,746 | A | 9/1966 | LeSuer |
| 3,361,673 | A | 1/1968 | Stuart |
| 3,368,972 | A | 2/1968 | Otto |
| 3,413,347 | A | 11/1968 | Worrel |
| 3,442,808 | A | 5/1969 | Traise |
| 3,448,047 | A | 6/1969 | Traise |
| 3,454,497 | A | 7/1969 | Wittner |
| 3,459,661 | A | 8/1969 | Schlobohm |
| 3,493,520 | A | 2/1970 | Verdol |
| 3,539,633 | A | 11/1970 | Piasek |
| 3,558,743 | A | 1/1971 | Verdol |
| 3,586,629 | A | 6/1971 | Otto |
| 3,591,598 | A | 7/1971 | Traise |
| 3,600,372 | A | 8/1971 | Udelhofen |
| 3,634,515 | A | 1/1972 | Piasek |
| 3,649,229 | A | 3/1972 | Otto |
| 3,663,561 | A | 5/1972 | Blaha |
| 3,673,251 | A | 6/1972 | Frampton |
| 3,676,089 | A | 7/1972 | Morris |
| 3,697,574 | A | 10/1972 | Piasek |
| 3,703,536 | A | 11/1972 | Piasek |
| 3,704,308 | A | 11/1972 | Piasek |
| 3,725,277 | A | 4/1973 | Worrel |
| 3,725,480 | A | 4/1973 | Traise |
| 3,726,882 | A | 4/1973 | Traise |
| 3,736,357 | A | 5/1973 | Piasek |
| 3,751,365 | A | 8/1973 | Piasek |
| 3,756,953 | A | 9/1973 | Piasek |
| 3,793,202 | A | 2/1974 | Piasek |
| 3,794,081 | A | 2/1974 | Fiser |
| 3,798,165 | A | 3/1974 | Piasek |
| 3,798,247 | A | 3/1974 | Piasek |
| 3,803,039 | A | 4/1974 | Piasek |
| 3,840,549 | A | 10/1974 | Blaha |
| 3,862,798 | A | 1/1975 | Hopkins |
| 3,872,019 | A | 3/1975 | Culbertson |
| 3,904,595 | A | 9/1975 | Plonsker |
| 3,957,746 | A | 5/1976 | Malec |
| 3,980,569 | A | 9/1976 | Pindar |
| 3,985,802 | A | 10/1976 | Piasek |
| 4,006,089 | A | 2/1977 | Chibnik |
| 4,011,380 | A | 3/1977 | West |
| 4,025,451 | A | 5/1977 | Plonsker |

(Continued)

FOREIGN PATENT DOCUMENTS

| | | |
|---|---|---|
| CA | 2189071 | 12/1995 |

(Continued)

OTHER PUBLICATIONS

Smith, N.L., J. Org. Chem. 1950, 15, 1125-1130.*

(Continued)

*Primary Examiner*—Glenn Caldarola
*Assistant Examiner*—Jim Goloboy

(57) ABSTRACT

A composition for use as an additive for fuels or lubricants. The composition includes a reaction product of a treated amine and a compound selected from the group consisting of hydrocarbyl succinic anhydrides, Mannich adducts derived from hydrocarbyl-substituted phenols reacted with formaldehydes, ethylene-propylene copolymers grafted with ethylenically unsaturated carboxylic groups, copolymers of unsaturated acids and polyolefins, and acid or ester functionalized hydrocarbon polymers. The reaction product is oil soluble and has a number average molecular weight ranging from about 900 to about 50,000 as determined by gel permeation chromatography. The treated amine includes an aliphatic or aromatic amine containing at least one primary or secondary amino group reacted with an aliphatic or aromatic nitrile and hydrogen.

38 Claims, No Drawings

U.S. PATENT DOCUMENTS 4,029,587 A 6/1977 Koch
4,058,468 A 11/1977 Malec
4,081,388 A * 3/1978 Soula et al. ..... 508/292
4,083,699 A 4/1978 Chibnik
4,090,854 A 5/1978 Davis
4,092,255 A 5/1978 Chapelet
4,094,802 A * 6/1978 Soula et al. ..... 508/291
4,146,489 A 3/1979 Stambaugh
4,153,567 A * 5/1979 Kluger et al. ..... 508/293
4,170,561 A 10/1979 Chapelet
4,173,540 A 11/1979 Lonstrup
4,178,259 A * 12/1979 King ..... 508/542
4,231,759 A * 11/1980 Udelhofen et al. ..... 44/415
4,234,435 A 11/1980 Meinhardt
4,250,045 A * 2/1981 Coupland et al. ..... 508/375
4,334,085 A 6/1982 Basalay
4,354,950 A 10/1982 Hammond
4,444,654 A 4/1984 Cargle
4,485,023 A 11/1984 Serres
4,614,593 A 9/1986 Roark
4,636,322 A 1/1987 Nalesnik
4,686,054 A 8/1987 Wisotsky
4,715,975 A 12/1987 Kapusciniski
4,732,942 A 3/1988 Liu
4,735,736 A * 4/1988 Chung ..... 508/233
4,769,043 A 9/1988 Kapusciniski
4,810,754 A 3/1989 McCrary
4,857,214 A 8/1989 Papay
4,863,623 A 9/1989 Nalesnik
4,877,415 A * 10/1989 Kapuscinski et al. ..... 44/330
5,055,213 A * 10/1991 Germanaud et al. ..... 508/234
5,071,919 A 12/1991 DeGonia
5,075,383 A 12/1991 Migdal
5,112,507 A 5/1992 Harrison
5,112,508 A 5/1992 DeRosa
5,137,980 A 8/1992 DeGonia
5,139,688 A 8/1992 Nalesnik
5,162,086 A 11/1992 Migdal
5,196,589 A 3/1993 O'Lenick, Jr.
5,238,588 A 8/1993 Nalesnik
5,242,613 A 9/1993 Ozbalik
5,286,264 A * 2/1994 Russo et al. ..... 44/347
5,294,354 A 3/1994 Papke
5,344,579 A 9/1994 Ohtani
5,372,735 A 12/1994 Ohtani
5,433,875 A 7/1995 Rollin
5,441,656 A 8/1995 Ohtani
5,443,875 A 8/1995 Liu
5,454,964 A 10/1995 Blackborow
5,523,008 A 6/1996 Boden
5,559,265 A 9/1996 Love
5,571,445 A * 11/1996 Srinivasan et al. ..... 508/189
5,595,964 A * 1/1997 Bardasz ..... 508/423
5,616,668 A 4/1997 Harrison
5,634,951 A 6/1997 Colucci
5,643,859 A * 7/1997 Gutierrez et al. ..... 508/454
5,652,201 A * 7/1997 Papay et al. ..... 508/228
5,663,126 A 9/1997 Boden
5,725,612 A 3/1998 Colucci
5,789,353 A 8/1998 Scattergood
5,814,586 A 9/1998 Boden
5,854,186 A 12/1998 Cusumano
5,872,084 A * 2/1999 Emert et al. ..... 508/293
5,873,917 A * 2/1999 Daly ..... 44/443
5,888,947 A * 3/1999 Lambert et al. ..... 508/491
6,001,786 A 12/1999 Gatto
6,060,437 A * 5/2000 Robson et al. ..... 508/371
6,096,691 A 8/2000 Conary
6,096,695 A 8/2000 Lam
6,107,250 A 8/2000 Tohyama
6,107,257 A 8/2000 Valcho
6,127,321 A 10/2000 Emert
6,187,721 B1 2/2001 Goldblatt
6,214,775 B1 4/2001 Harrison
6,299,655 B1 * 10/2001 Steckel et al. ..... 44/331
6,427,647 B1 * 8/2002 Galka et al. ..... 123/73 B
6,599,865 B1 7/2003 Esche

FOREIGN PATENT DOCUMENTS

GB 2007234 5/1979
JP 61-069758 4/1986
JP 01-095194 4/1989
JP 01095194 A * 4/1989
JP 03-502698 6/1991
JP 05-271188 10/1993
JP 2002-525384 8/2002
WO 9535329 12/1995

OTHER PUBLICATIONS

Partial European Search Report, European Patent Office, European Patent Application No. 05250863.7 - 2104 / 1564282, May 11, 2009, 4 pages.

* cited by examiner

LUBRICANT AND FUEL ADDITIVES DERIVED FROM TREATED AMINES

TECHNICAL FIELD

The following disclosure is directed to additives for fuel and lubricant compositions and in particular to additives derived from treated amines that provide improved performance characteristics for the fuel and lubricant compositions, to compositions containing the additives, to methods for improving engine and drive train performance, and to methods for using the additives.

BACKGROUND

Chemical compositions are added to fuels and lubricants to control the physical and chemical properties of the fuel and lubricant compositions and to improve engine performance. Such additives include dispersants, antioxidants, viscosity index modifiers, corrosion inhibitors, antiwear agents, friction modifiers, and the like. Dispersants are particularly important additives for lubricant and fuel compositions. Dispersants solubilize sludge, resin and other combustion byproducts so that they can be removed from the system rather than being deposited on internal engine components.

Of the dispersants commonly used in lubricant and fuel applications, Mannich base additives, hydrocarbyl amine adducts, and hydrocarbyl succinic acid derivatives exhibit excellent properties for such applications. Mannich base dispersants are typically produced by reacting alkyl-substituted phenols with aldehydes and amines, such as is described in U.S. Pat. Nos. 3,697,574; 3,704,308; 3,736,357; 4,334,085; and 5,433,875.

Hydrocarbyl succinic acid based dispersants are derived by alkylating, for example, maleic anhydride, acid, ester or halide with an olefinic hydrocarbon to form an acylating agent as described in U.S. Pat. Nos. 5,071,919 and 4,234,435. The acylating agent is then reacted with an amine, typically a polyalkylene amine or amine to form a dispersant, such as described in U.S. Pat. Nos. 3,219,666; 3,272,746; 4,173,540; 4,686,054; and 6,127,321.

Despite the wide variety of additives available for lubricant and fuel applications, there remains a need for improved additives to provide increased deposit control and dispersancy without incurring a cost disadvantage.

SUMMARY OF THE EMBODIMENTS

In one embodiment herein is presented a composition for use as an additive for fuels and lubricants. The composition includes a reaction product of a treated amine and a compound selected from the group consisting of hydrocarbyl succinic anhydrides, Mannich adducts derived from hydrocarbyl-substituted phenols reacted with formaldehydes, ethylene-propylene copolymers grafted with ethylenically unsaturated carboxylic groups, copolymers of unsaturated acids and polyolefins, and acid or ester functionalized hydrocarbon polymers. The reaction product is oil soluble and has a number average molecular weight ranging from about 900 to about 50,000 as determined by gel permeation chromatography. The treated amine includes an aliphatic or aromatic amine containing at least one primary or secondary amino group reacted with acrylonitrile or at least one homologue thereof followed by reduction to the primary amine.

In another embodiment there is provided a lubricant or fuel additive containing a reaction product of a treated amine and a compound selected from the group consisting of hydrocarbyl succinic anhydrides, Mannich adducts derived from hydrocarbyl-substituted phenols reacted with formaldehydes, ethylene-propylene copolymers grafted with ethylenically unsaturated carboxylic groups, copolymers of unsaturated acids and polyolefins, and acid or ester functionalized hydrocarbon polymers. The reaction product is oil soluble and has a number average molecular weight ranging from about 900 to about 50,000 as determined by gel permeation chromatography. The treated amine includes an aliphatic or aromatic amine containing at least one primary or secondary amino group reacted with acrylonitrile or at least one homologue thereof followed by reduction to the primary amine.

In yet another embodiment, a method of lubricating moving parts of a vehicle is provided. The method includes using as a lubricating oil for one or more moving parts of the vehicle a lubricant composition containing a lubricant and a lubricant additive. The lubricant additive contains a reaction product of a treated amine and a compound selected from the group consisting of hydrocarbyl succinic anhydrides, Mannich adducts derived from hydrocarbyl-substituted phenols reacted with formaldehydes, ethylene-propylene copolymers grafted with ethylenically unsaturated carboxylic groups, copolymers of unsaturated acids and polyolefins, and acid or ester functionalized hydrocarbon polymers. The reaction product is oil soluble and has a number average molecular weight ranging from about 900 to about 50,000 as determined by gel permeation chromatography. The treated amine comprises an aliphatic or aromatic amine containing at least one primary or secondary amino group reacted with acrylonitrile or at least one homologue thereof followed by reduction to the primary amine.

A further embodiment provides a method for increasing soot and sludge dispersancy in a diesel engine. According to the method, a diesel fuel containing an additive including a reaction product of a treated amine and a compound selected from the group consisting of hydrocarbyl succinic anhydrides, Mannich adducts derived from hydrocarbyl-substituted phenols reacted with formaldehydes, ethylene-propylene copolymers grafted with ethylenically unsaturated carboxylic groups, copolymers of unsaturated acids and polyolefins, and acid or ester functionalized hydrocarbon polymers is provided. The reaction product is oil soluble and has a number average molecular weight ranging from about 900 to about 50,000 as determined by gel permeation chromatography. The treated amine comprises an aliphatic or aromatic amine containing at least one primary or secondary amino group reacted with acrylonitrile or at least one homologue thereof followed by reduction to the primary amine.

An advantage of the embodiments described herein is that it provides improved dispersants, detergents, and viscosity index (VI) improvers for lubricant and fuel compositions, lubricant and fuel compositions containing the improved dispersants, detergents, VI improvers and methods for improving engine performance using the improved dispersants, detergents, or VI improvers. Dispersants in the lubricating oils and fuels suspend thermal decomposition and oxidation products, such as soot and sludge, and reduce or retard the formation of deposits on lubricated surfaces. Detergents in fuels reduce or eliminate deposits in gasoline and diesel engines. VI improvers in lubricants modify the viscosity characteristics of the lubricants over a wider range of temperatures.

The additives described herein are suitable for crankcase lubricants for diesel and gasoline engines, as a dispersant for automatic transmission fluids, as an additive for continuously variable gear oils, as a component of hydraulic oils, as an additive for gasoline and diesel powered engines. Other features and advantages of the additive will be evident by reference to the following detailed description which is intended to exemplify aspects of the preferred embodiments without intending to limit the embodiments described herein.

DETAILED DESCRIPTION OF THE PREFERRED EMBODIMENTS

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Of the hydrocarbyl substituents, olefinic hydrocarbons are particularly preferred for the hydrocarbyl substituent. Olefinic hydrocarbons such as isobutene are typically made by cracking a hydrocarbon stream to produce a hydrocarbon mixture of essentially $C_4$-hydrocarbons. For example, thermocracking processes (streamcracker) produce $C_4$ cuts comprising $C_4$ paraffins and $C_4$ olefins, with a major component being isobutene. Polymization of isobutene by well known processes provides a hydrocarbyl substituent of having a desired molecular weight for the compositions described herein.

An important component of the additive compositions described herein is a treated amine. The term "treated" in the context of this disclosure means that an amine is reacted with acrylonitrile or at least one homologue thereof followed by reduction to the primary amine. An amine or mixture of amines may be treated according to the invention. For example, the amines may be selected from an aliphatic, linear or branched amines. The amines may also be selected from an aromatic and heterocyclic amines. Combinations of aliphatic, aromatic, and heterocyclic amines may also be treated according to the invention. The treated amines may also be mixed with an untreated amines before further reaction to provide the additive compositions described herein. The amines treated according to the invention preferably include at least one primary or secondary amino group.

The aliphatic amines include, but are not limited to the following: aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine is a mixture of polyalkyleneamines comprising small amounts of lower amine oligomers such as TEPA and PEHA but primarily oligomers with 7 or more nitrogen atoms, 2 or more primary amines per molecule, and more extensive branching than conventional amine mixtures.

Aromatic amines that are also suitable in preparing the compositions described herein include N-arylphenylenediamines, such as N-phenylphenylene-diamines, for example, N-phenyl-1,4-phenylenediamine, N-phenyl-1,3-phenylendiamine, and N-phenyl-1,2-phenylenediamine.

Heterocyclic amines that may be used include, but are not limited to, aminothiazoles such as aminothiazole, aminobenzothiazole, aminobenzothiadiazole and aminoalkylthiazole; aminocarbazoles; aminoindoles; aminopyrroles; aminoindazolinones; aminomercaptotriazoles; aminoperimidines; aminoalkyl imidazoles, such as 1-(2-aminoethyl)imidazole, 1-(3-aminopropyl)imidazole; and aminoalkyl morpholines, such as 4-(3-aminopropyl)morpholine. These amines are described in more detail in U.S. Pat. Nos. 4,863,623; and 5,075,383.

Additional amines useful in forming the hydrocarbyl-substituted succinimides include amines having at least one primary or secondary amino group and at least one tertiary amino group in the molecule as taught in U.S. Pat. Nos. 5,634,951 and 5,725,612. Examples of suitable amines include N,N,N",N"-tetraalkyldialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylenetetramines (one terminal tertiary amino group, two internal tertiary amino groups and one terminal secondary amino group), tris(dialkylaminoalkyl) aminoalkylmethanes (three terminal tertiary amino groups and one terminal primary amino group), and like compounds, wherein the alkyl groups are the same or different and typically contain no more than about 12 carbon atoms each, and which preferably contain from 1 to 4 carbon atoms each. Most preferably these alkyl groups are methyl and/or ethyl groups.

Hydroxyamines suitable for use herein include compounds, oligomers or polymers containing at least one primary or secondary amine. Examples of hydroxyamines suitable for use herein include aminoethylethanolamine (AEEA), aminopropyldiethanolamine (APDEA), ethanolamine, diethanolamine (DEA), partially propoxylated hexamethylene diamine (for example HMDA-2PO or HMDA-3PO), 3-amino-1,2-propanediol, tris(hydroxymethyl)aminomethane, and 2-amino-1,3-propanediol.

According to the treatment process, the amine or mixture of amines is reacted with one or more equivalents of an alpha-beta unsaturated nitrile per primary or secondary amine. A particularly preferred nitrile is acrylonitrile, $H_2C{=}CHCN$.

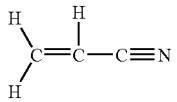

Homologues can include

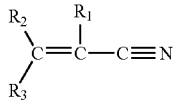

where $R_1$=$R_2$=$R_3$=any combination of hydrogen, alkyl, aryl, alkenyl, arylalkyl groups. $R_1$, $R_2$ and $R_3$ can be the same or different.

The intermediate can then be hydrogenated, optionally in the presence of a hydrogenation catalyst, to form the treated amine. Processes for the reductive catalytic amination of nitrites are described, for example, in U.S. Pat. No. 3,673,251 to Frampton et al., the disclosure of which is incorporated herein by reference thereto. Higher molecular weight amine macromolecules may be provided by further reacting the amination product with additional nitrile under similar reaction conditions until the desired molecular weight is obtained.

Improved compositions for use as additives in fuels and lubricants may be made with the treated amines or with a combination of treated and untreated amines. Such compositions include, but are not limited to, dispersants, detergents, VI improvers and the like. Such compositions include reaction products of the foregoing treated and/or untreated amines and a compound selected from the group consisting of hydrocarbyl succinic anhydrides or acids, Mannich adducts derived from hydrocarbyl-substituted phenols reacted with formaldehydes, ethylene-propylene copolymers grafted with ethylenically unsaturated carboxylic groups, copolymers of unsaturated acids and polyolefins, and acid or ester functionalized hydrocarbon polymers. It is preferred that the reaction product be oil soluble and have a number average molecular weight ranging from about 900 to about 50,000 as determined by gel permeation chromatography.

Hydrocarbyl-substituted succinic acylating agents are used to make succcinimide reaction products with the treated amines. The hydrocarbyl-substituted succinic acylating agents include, but are not limited to, hydrocarbyl-substituted succinic acids, hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

Hydrocarbyl substituted acylating agents are made by well known techniques, such as by the reaction of maleic anhydride with the desired polyolefin or chlorinated polyolefin, under reaction conditions well known in the art. For example, such succinic anhydrides may be prepared by the thermal reaction of a polyolefin and maleic anhydride, as described in U.S. Pat. Nos. 3,361,673; 3,676,089; and 5,454,964. Alternatively, the substituted succinic anhydrides can be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S Pat. Nos. 4,234,435; 5,620,486 and 5,393,309. Typically, these hydrocarbyl-substituents will contain from 40 to 500 carbon atoms.

The mole ratio of maleic anhydride to olefin can vary widely. For example, the mole ratio may vary from 5:1 to 0.5:1, with a more preferred range of 1:1 to 2.0:1. With olefins such as polyisobutylene having a number average molecular weight of 500 to 7000, preferably 800 to 3000 or higher and the ethylene-alpha-olefin copolymers, the maleic anhydride is preferably used in stoichiometric excess, e.g. 1.1 to 3 moles maleic anhydride per mole of olefin. The unreacted maleic anhydride can be vaporized from the resultant reaction mixture.

The mole ratio of PIBSA to treated amine varies based on the number of primary amines present in the treated amine. In one embodiment can be reacted one succinic anhydride group or moiety per each primary amine present in the treated amine. Fewer succinic anhydride equivalent may be added to make a "mono-succinimide" equivalent. A mono-succinimide is defined as having uncapped primary amines present in the succinimide. Also, extra succinic anhydride moieties or groups can be added to cap other nitrogens on the amine.

For one embodiment the reaction product is the composition wherein the reaction product comprises a hydrocarbyl-substituted succinimide derived from the treated amine and a hydrocarbyl-substituted succinic acid having a ratio of succinic acid to treated amine ranging from about 0.3:1.0 to about 12.0:1.

Ultimately, engine performance of the additive will determine the PIBSA to treated amine ratio.

The foregoing succinimide composition may also be a post-treated succinimide made, for example, by treating the succinimide with maleic anhydride, alkyl maleic anhydrides such as PIBSA, and/or boric acid as described, for example, in U.S. Pat. No. 5,789,353 to Scattergood, or by treating the dispersant with one or more of nonylphenol, formaldehyde and glycolic acid as described, for example, in U.S. Pat. Nos. 4,636,322; 5,137,980 to DeGonia, et al., or ethylene carbonate or cyclic carbonate, U.S. Pat. No. 6,214,775.

The Mannich base reaction products are preferably derived from a reaction product of an alkyl phenol, typically having a long chain alkyl substituent on the ring, with one or more aliphatic aldehydes containing from 1 to about 7 carbon atoms (especially formaldehyde and derivatives thereof), and treated and/or untreated amines as described above. The Mannich reaction products may be made by the procedures described for example in U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,904,595; 3,957,746; 3,980,569; 3,985,802; 4,006,089; 4,011,380; 4,025,451; 4,058,468; 4,083,699; 4,090,854; 4,354,950; and 4,485,023; and 5,443,875.

The preferred Mannich base reaction products are Mannich base ashless dispersants and detergents formed by condensing about one molar proportion of long chain hydrocarbon-substituted phenol with from about 1 to 2.5 moles of formaldehyde and from about 0.5 to 2 moles of the treated and/or untreated amine.

Detergents, dispersants, and VI improvers according to the disclosure may also be made with the treated amines and ethylene-propylene copolymers grafted with ethylenically unsaturated carboxylic groups, copolymers of unsaturated acids and polyolefins, and acid or ester functionalized hydrocarbon polymers. For example, an ethylene copolymer or terpolymer of a $C_3$ to $C_{10}$ alpha-monoolefin and optionally a non-conjugated diene or triene having a number average molecular weight ranging from about 5,500 to about 50,000 as determined by gel permeation chromatography, having grafted thereon an ethylenically unsaturated carboxylic functional group may be reacted with the treated amines described herein. Ethylene propylene copolymers and linear ethylene-propylene copolymers grafted with succinic anhydride (EPSA and LEPSA) may be reacted with the treated amines alone or in combination with other nitrogen containing compounds described above to provide improved additives according to the disclosure. The foregoing and more complex polymer substrates are described in detail, for example, in U.S. Pat. Nos. 5,075,383; 5,139,688; 5,162,086; and 5,238,588; and 6,107,258, the disclosures of which are incorporated herein by reference thereto.

Copolymers of unsaturated acids and polyolefins are prepared by reacting a high molecular weight olefin, such as a high molecular weight alkylvinylidene olefin, with an unsaturated acidic reactant in the presence of a free radical initiator. These copolymers may then be reacted with treated amines according to the present disclosure to provide improved compositions and additives for fuels and lubricants. Methods for preparing copolymers of unsaturated acids and polyolefins are disclosed, for example, in U.S. Pat. Nos. 5,112,507 and 5,616,668, the disclosures of which are incorporated herein by reference thereto.

Still another hydrocarbyl polymer that may be reacted with the treated amines according to the invention includes a Koch functionalized hydrocarbon product. The Koch functionalized hydrocarbon product is a polymer of the formula:

$$\text{POLY-}(CR^1R^2\text{—}CO\text{—}Y\text{—}R^3)_n,$$

wherein POLY is a hydrocarbon polymer backbone having a number average molecular weight of at least about 500 as determined by gel permeation chromatography, n is an number greater than zero, $R^1$, $R^2$, and $R^3$ may be the same or different and are each selected from hydrogen and a hydrocarbyl group with the proviso that either $R^1$ and $R^2$ are selected such that at least 50 mole % of the —$CR^1R^2$ groups do not contain $R^1$ and $R^2$ as hydrogen, or $R^3$ as an aryl substituted aryl group or a substituted hydrocarbyl group. The forgoing polymers are described in detail in U.S. Pat. No. 5,854,186, the disclosures of which are incorporated herein by reference thereto.

Additives for fuels and lubricants containing the reaction product as described herein may be used alone, or preferably, in combination with other conventional lubricant and fuel additive components such as friction modifiers, seal swell agents, antiwear agents, antioxidants, foam inhibitors, friction modifiers, rust inhibitors, corrosion inhibitors, demulsifiers, viscosity improvers, detergents, and the like. Various of these components are well known to those skilled in the art and are preferably used in conventional amounts with the additives and compositions described herein.

For example, suitable friction modifiers are described in U.S. Pat. Nos. 5,344,579; 5,372,735; and 5,441,656. Seal swell agents are described, for example, in U.S. Pat. Nos. 3,794,081 and 4,029,587. Antiwear and/or extreme pressure agents are disclosed in U.S. Pat. Nos. 4,857,214; 5,242,613; and 6,096,691. Suitable antioxidants are described in U.S. Pat. Nos. 5,559,265; 6,001,786; 6,096,695; and 6,599,865. Foam inhibitors suitable for compositions and additives described herein are set forth in U.S. Pat. Nos. 3,235,498; 3,235,499; and 3,235,502. Rust or corrosion inhibitors are described in U.S. Pat. Nos. 2,765,289; 2,749,311; 2,760,933; 2,850,453; 2,910,439; 3,663,561; 3,862,798; and 3,840,549. Viscosity index improvers and processes for making them are taught in, for example, U.S. Pat. Nos. 4,732,942; 4,863,623; 5,075,383; 5,112,508; 5,238,588; and 6,107,257. Multi-functional viscosity index improvers are taught in U.S. Pat. Nos. 4,092,255; 4,170,561; 4,146,489; 4,715,975; 4,769,043; 4,810,754; 5,294,354; 5,523,008; 5,663,126; and 5,814,586; and 6,187,721. Demulsifiers are described in U.S. Pat. Nos. 4,444,654 and 4,614,593.

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, and polysilicone oils. Natural base oils include mineral lubrication oils which may vary widely as to their crude source, e.g., as to whether they are paraffinic, naphthenic, or mixed paraffinic-naphthenic. The base oil typically has a viscosity of about 2.5 to about 15 cSt and preferably about 2.5 to about 11 cSt at 100° C.

Accordingly, the base oil used which may be used may be selected from any of the base oils in Groups I-V as specified in the American Petroleum Institute (API) Base Oil Interchangeability Guidelines. Such base oil groups are as follows:

| Base Oil Group[1] | Sulfur (wt. %) | | Saturates (wt. %) | Viscosity Index |
|---|---|---|---|---|
| Group I | >0.03 | and/or | <90 | 80 to 120 |
| Group II | ≦0.03 | And | ≧90 | 80 to 120 |
| Group II | ≦0.03 | And | ≧90 | ≧120 |
| Group IV | all polyalphaolefins (PAOs) | | | |
| Group V | all others not included in Groups I-IV | | | |

[1]Groups I-III are mineral oil base stocks.

Additives used in formulating the compositions described herein can be blended into the base oil individually or in various sub-combinations. However, it is preferable to blend all of the components concurrently using an additive concentrate (i.e., additives plus a diluent oil.). The use of an additive concentrate takes advantage of the mutual compatibility afforded by the combination of ingredients when in the form of an additive concentrate. Also, the use of a concentrate reduces blending time and lessens the possibility of blending errors.

The following example is given for the purpose of exemplifying aspects of the embodiments and is not intended to limit the embodiments in any way. In the following example, a lubricant containing a dispersant made with a treated amine according to the invention was compared with a conventional lubricant in a CATERPILLAR 1N engine test. The test evaluated the performance of the compositions with respect to piston deposits, ring sticking, ring and cylinder wear, piston, ring and liner scuffing, as well as oil consumption.

The test employed a CATERPILLAR 1Y540 single-cylinder, direct injection, diesel test engine with a four-valve arrangement and aluminum pistons having a 13.7 cm bore and a 16.5 cm stroke resulting in a displacement of 2,440 cubic cm. The engine test was run according to ASTM procedure D6750-$_{02}$. The lubricant used was an experimental 15W-40W low sulfur, low ash, low phosphorus heavy duty diesel engine oil (% S=0.08 wgt.; % P=0.019; % sulfated ash=0.35). In the example, a succinimide dispersant made with the treated amine was used to replace a portion of a commercial dispersant, available from Ethyl Corporation of Richmond, Va. In all other respect, the test lubricant was the same as the control lubricant composition as shown in the following table.

Thus, in another embodiment is presented a lubricant composition comprising from 0.1 to 10 weight % of an oil of lubricating viscosity and an amount of the treated amine reaction product taught herein, wherein the lubricant composition has a sulfur content of less than 0.5 weight %, a phosphorus content of less than 0.11 weight %, and a sulfated ash content of less than 1.2 weight %.

| Component Description | Control Lubricant | Test Lubricant |
|---|---|---|
| STAR 5, MOTIVA, Base Oil (wt. %) | 52.0 | 52.0 |
| STAR 8, MOTIVA, Base oil (wt. %) | 27.0 | 27.0 |
| Dispersant made with treated amine (wt. %) | — | 2.25 |
| dispersant VI improver (wt. %) | 8.50 | 8.50 |
| methacrylate, pour point depressant (wt. %) | 0.20 | 0.20 |
| succinimide 2100 mw, dispersant (wt. %) | 3.00 | 0.75 |
| 1300 mw succinimide dispersant (wt. %) | 5.03 | 5.03 |
| overbased calcium sulfonate (wt. %) | 0.50 | 0.50 |
| sec. ZDDP, antiwear additive (wt. %) | 0.25 | 0.25 |
| alkyldiphenylamine, aminic antioxidant (wt. %) | 0.50 | 0.50 |
| phenolic antioxidant (wt. %) | 0.50 | 0.50 |
| silicone, antifoam agent (wt. %) | 0.01 | 0.01 |
| aminoguanidine, antiwear agent (wt. %) | 0.50 | 0.50 |
| diluent oil (wt. %) | 1.06 | 1.06 |
| salicylate detergent (wt. %) | 0.95 | 0.95 |
| Engine Test Results for API CI-4 Category | | |
| Top land heavy carbon (carbon desposits on top of piston) (TLHC) (%) (3 max) | 0 | 0 |
| Top groove (ring groove carbon deposits) fill (TGF) (%) (20 max) | 9 | 9 |
| Weighted demerits/deposits 1-N method (WD) (286.2 max, first time pass) | 260.9 | 167.0 |
| Brake specific oil consumption (BSOC) avg. (g/kW-hr), (0.5 max) | 0.205 | 0.160 |

As shown by the foregoing test, a lubricant containing less than 3 wt. % of a dispersant made with a treated amine provided about 36% lower deposit demerits. This result indicates significantly improved dispersant characteristics compared with dispersants that are not made with the treated amine described herein.

Dispersants made with treated amines are illustrated in the following examples. In the examples, the amine was purified polyethyleneamine obtained from commercially available ethyleneamine E-100 from Huntsman Corporation of Houston, Tex. Ethyleneamine E-100 is a mixture of tetraethylenepentamine (TEPA), pentaethylenehexamine (PEHA), hexaethyleneheptamine (HEHA), and higher molecular weight products and has the structure:

$$H_2NCH_2CH_2(NHCH_2CH_2)_xNH_2$$

Wherein x is an integer of 3, 4, 5, or higher. The polyethylenamine was reacted with sufficient acrylonitrile to add 4 moles of acrylonitrile to each mole equivalent of polyethyleneamine to form a reaction intermediate. The intermediate was then hydrogenated in the presence of a catalyst to form the treated amine product. The treated amine product had about 29 wt. % nitrogen, an amine value of 1150, a molecular weight of about 500, and a kinematic viscosity of about 177 centistokes at 40° C. The foregoing treated amine was reacted with polyisobutylene succinic anhydride (PIBSA) in the following examples.

EXAMPLE 1

Into a reactor equipped with a condenser, dean-stark trap, thermocouple, gas-inlet and stirrer were added 522.6 grams (1 mole) of 2100 molecular weight PIBSA with an SA/PIB ratio of 1.06:1 and 517.2 grams of diluent oil. Nitrogen gas was bubbled into the reactants and the reactants were heated to 60° C. At 60° C., the treated amine (25 grams, 0.05 mols) was charged to the reactor. The reactants were heated to 160° C. and maintained at that reaction temperature with stirring for 6 hours. Water from the reaction was collected in the trap. At the end of the reaction time, the product was vacuum stripped for one hour at 160° C. and filtered hot through filter aid. The product had 0.733 wt. % N, a kinematic viscosity of 262.8 at 100° C., a total acid number (TAN) of 1.5 and a total base number (TBN) of 16.6.

EXAMPLE 2

Into a reactor equipped with a condenser, dean-stark trap, thermocouple, gas-inlet and stirrer were added 322.3 grams (0.200 moles) of 2100 molecular weight PIBSA with an SA/PIB ratio of 1.6:1 and 389 grams of diluent oil. Nitrogen gas was bubbled into the reactants and the reactants were heated to 160° C. At 160° C., the treated amine (25 grams, 0.05 mols) was charged to the reactor. The reactants were maintained at the reaction temperature with stirring for 6 hours. Water from the reaction was collected in the trap. At the end of the reaction time, the product was vacuum stripped for one hour at 160° C. and filtered hot through a filter aid. The product had 1.10 wt. % N, a kinematic viscosity of 382 at 100° C., a total acid number (TAN) of 0.7 and a total base number (TBN) of 23.8.

EXAMPLE 3

Into a reactor equipped with a condenser, dean-stark trap, thermocouple, gas-inlet and stirrer were added 322.3 grams (0.20 moles) 1300 molecular weight PIBSA with an SA/PIB ratio of 1.1:1 and 409.4 grams of diluent oil. Nitrogen gas was bubbled into the reactants and the reactants were heated to 60° C. At 60° C., the treated amine (25 grams, 0.05 mols) was charged to the reactor. The reactants were heated to 160° C. and maintained at that reaction temperature with stirring for 6 hours. Water from the reaction was collected in the trap. At the end of the reaction time, the product was vacuum stripped for one hour at 160° C. and filtered hot through a filter aid. The product had 1.08 wt. % N, a kinematic viscosity of 116 at 100° C., a total acid number (TAN) of 3.5 and a total base number (TBN) of 21.9.

One embodiment is directed to a method of lubricating moving parts of a vehicle, wherein said method comprises using as the crankcase lubricating oil for said internal combustion engine a lubricating oil containing a dispersant, or VI improver made with a treated amine as described herein, wherein the dispersant or VI improver is present in an amount sufficient to reduce the wear, and/or improve the soot and sludge dispersancy in an internal combustion engine operated using said crankcase lubricating oil, as compared to the wear in said engine operated in the same manner and using the same crankcase lubricating oil except that the oil is devoid of the dispersant or VI improver. Accordingly, for reducing wear, the dispersant or VI improver is typically present in the lubricating oil in an amount of from 0.1 to 3 weight percent based on the total weight of the oil. Representative of the types of wear that may be reduced using the compositions described herein include cam wear and lifter wear. In other embodiments, lubricant compositions described herein may be used or formulated as gear oil, hydraulic oils, automatic transmission fluids, and the like.

Another embodiment is directed to a method for decreasing combustion chamber and/or intake valve deposits in a diesel or gasoline engine. Another method includes providing a diesel fuel containing as detergent additive, a detergent made with the treated amine according to the disclosure. A fuel containing such detergent when used in an engine is sufficient to decrease combustion chamber deposits resulting from combustion of the fuel as compared to combustion of a fuel devoid of the detergent made with the treated amine.

It is contemplated that the treated amine may be mixed with conventional amines during a reaction to make detergents, dispersants and VI improvers. Such detergents, dispersants, and VI improvers made with treated and untreated amines should also exhibit improved characteristics as described herein. Likewise, it is contemplated that all or a portion of a conventional detergent, dispersant or VI improver may be replace with a detergent, dispersant or VI improver made with the treated amine.

At numerous places throughout this specification, reference has been made to a number of U.S. Patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The applicants do not intend to dedicate any disclosed embodiments to the public, and to the extent any disclosed modifications or alterations may not literally fall within the scope of the claims, they are considered to be part hereof under the doctrine of equivalents.

What is claimed is:

1. A composition for use as an additive for fuels or lubricants comprising a reaction product comprising Mannich adducts derived from hydrocarbyl-substituted phenols, formaldehydes and treated amines, wherein the reaction product is oil soluble and has a number average molecular weight ranging from about 900 to about 50,000 as determined by gel permeation chromatography, and wherein the treated amine comprises an aliphatic or aromatic amine containing at least one primary or secondary amino group reacted with acrylonitrile or at least one homologue thereof followed by reduction to the primary amine, with the proviso that the aliphatic amine is chosen from aminoguanidine bicarbonate; a mixture of amines comprising tetraethylene pentamine, pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the proviso that the aromatic amine is chosen from N-arylphenylenediamines; and with the further proviso that if the aliphatic amine is a hydroxyamine, the hydroxyamine is chosen from oligomers, polymers, aminoethylethanolamine, aminopropyldiethanolamine, partially propoxylated hexamethylene diamine, 3-amino-1,2-propanediol, tris(hydroxymethyl)aminomethane, and 2-amino-1,3-propanediol.

2. The composition of claim 1, wherein the aliphatic or aromatic amine is reacted with one to five equivalents of acrylonitrile or one of its homologues, followed by reduction of the primary amine per primary or secondary amino group in the amine.

3. The composition of claim 1, wherein the amine is a substantially linear aliphatic amine.

4. The composition of claim 1, wherein the amine is an aromatic amine.

5. The composition of claim 1, wherein the reaction product comprises a hydrocarbyl-substituted succinimide derived from the treated amine and a hydrocarbyl-substituted succinic acid having a mole ratio of succinic acid to treated amine ranging from about 0.3:1.0 to about 12.0:1.

6. The composition of claim 1, wherein the reaction product further comprises an untreated amine selected from the group consisting of aliphatic amines and aromatic amines.

7. A lubricant composition comprising an oil of lubricating viscosity and from about 0.1 to 10 wt. %, based on the total weight of the composition of the reaction product of claim 1.

8. A vehicle having moving parts and containing a lubricant for lubricating the moving parts, the lubricant comprising an oil of lubricating viscosity and from about 0.1 to 10 wt. %, based on the total weight of the lubricant composition, of the reaction product of claim 1.

9. An additive package for lubricants or fuels comprising a reaction product of claim 1 and a composition selected from the group consisting of hydrocarbyl succinic anhydrides reacted with an amine, Mannich adducts derived from hydrocarbyl-substituted phenols reacted with formaldehydes and amines, ethylene-propylene copolymers grafted with ethylenically unsaturated carboxylic groups reacted with amines, copolymers of unsaturated acids and polyolefins reacted with amines, and acid or ester functionalized hydrocarbon polymers reacted with amines, wherein the amines comprise untreated aliphatic or aromatic amines.

10. A lubricant composition comprising an oil of lubricating viscosity and from about 0.1 to 10 wt. %, based on the total weight of the lubricant composition, of the additive of claim 9.

11. A fuel composition comprising a hydrocarbyl fuel and from about 5 to about 200 pounds per thousand barrels of the composition of claim 1.

12. A lubricant additive comprising a reaction product comprising Mannich adducts derived from hydrocarbyl-substituted phenols, formaldehydes and treated amines, wherein the reaction product is oil soluble and has a number average molecular weight ranging from about 900 to about 50,000 as determined by gel permeation chromatography, and wherein the treated amine comprises an aliphatic or aromatic amine containing at least one primary or secondary amino group reacted with acrylonitrile or one of its homologues, followed by reduction to the primary amine, with the proviso that the aliphatic amine is chosen from aminoguanidine bicarbonate; a mixture of amines comprising tetraethylene pentamine, pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the proviso that the aromatic amine is chosen from N-arylphenylenediamines; and with the further proviso that if the aliphatic or aromatic amine is a hydroxyamine, the hydroxyamine is chosen from oligomers, polymers, aminoethylethanolamine, aminopropyldiethanolamine, partially propoxylated hexamethylene diamine, 3-amino-1,2-propanediol, tris (hydroxymethyl)aminomethane, and 2-amino-1,3-propanediol.

13. The lubricant additive of claim 12, wherein the reaction product further comprises an untreated amine selected from the group consisting of aliphatic and aromatic amines.

14. The lubricant additive of claim 12, further comprising a composition selected from the group consisting of hydrocarbyl succinic anhydrides reacted with amines, Mannich adducts derived from hydrocarbyl-substituted phenols reacted with formaldehydes and amines, ethylene-propylene copolymers grafted with ethylenically unsaturated carboxylic groups reacted with amines, copolymers of unsaturated acids and polyolefins reacted with amines, and acid or ester functionalized hydrocarbon polymers reacted with amines, wherein the amines comprise untreated aliphatic or aromatic amines.

15. The lubricant additive of claim 12, wherein the reaction product is a post treated reaction product.

16. A lubricant composition comprising an oil of lubricating viscosity and from about 0.1 to 10 wt. %, based on the total weight of the lubricant composition, of the lubricant additive of claim 12.

17. A fuel additive comprising a reaction product comprising Mannich adducts derived from hydrocarbyl-substituted phenols, formaldehydes and treated amines, wherein the reaction product is oil soluble and has a number average molecular weight ranging from about 900 to about 50,000 as determined by gel permeation chromatography, and wherein the treated amine comprises an aliphatic or aromatic amine containing at least one primary or secondary amino group reacted with acrylonitrile or at least one homologue thereof, followed by reduction to the primary amine with the proviso that the aliphatic amine is chosen from aminoguanidine bicarbonate; a mixture of amines comprising tetraethylene pentamine, pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the proviso that the aromatic amine is chosen from N-arylphenylenediamines; and with the further proviso that if the aliphatic or aromatic amine is a hydroxyamine, the hydroxyamine is chosen from oligomers, polymers, aminoethylethanolamine, aminopropyldiethanolamine, partially propoxylated hexamethylene diamine, 3-amino-1,2-propanediol, tris (hydroxymethyl)aminomethane, and 2-amino-1,3-propanediol.

18. The fuel additive of claim 17, wherein the reaction product further comprises an untreated amine selected from the group consisting of aliphatic and aromatic amines.

19. The fuel additive of claim 17, further comprising a composition selected from the group consisting of hydrocarbyl succinic anhydrides reacted with amines, Mannich adducts derived from hydrocarbyl-substituted phenols reacted with formaldehydes and amines, ethylene-propylene copolymers grafted with ethylenically unsaturated carboxylic groups reacted with amines, copolymers of unsaturated acids and polyolefins reacted with amines, and acid or ester functionalized hydrocarbon polymers reacted with amines, wherein the amines comprise untreated aliphatic or aromatic amines.

20. The fuel additive of claim 17, wherein the reaction product is a post treated reaction product.

21. A fuel composition comprising a fuel and from about 5 to 200 pounds per thousand barrels of the lubricant additive of claim 12.

22. A method of lubricating moving parts of a vehicle, the method comprising using as a lubricating oil for one or more moving parts of the vehicle a lubricant composition containing a lubricant and a lubricant additive, the lubricant additive including a reaction product comprising Mannich adducts derived from hydrocarbyl-substituted phenols, formaldehydes and treated amines, wherein the reaction product is oil soluble and has a number average molecular weight ranging from about 900 to about 50,000 as determined by gel permeation chromatography, and wherein the treated amine comprises an aliphatic or aromatic amine containing at least one primary or secondary amino group reacted with acrylonitrile or a homologue thereof, followed by reduction to the primary amine, with the proviso that the aliphatic amine is chosen from aminoguanidine bicarbonate; a mixture of amines comprising tetraethylene pentamine, pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the proviso that the aromatic amine is chosen from N-arylphenylenediamines; and with the further proviso that if the aliphatic or aromatic amine is a hydroxyamine, the hydroxyamine is chosen from oligomers, polymers, aminoethylethanolamine, aminopropyldiethanolamine, partially propoxylated hexamethylene diamine, 3-amino-1,2-propanediol, tris (hydroxymethyl)aminomethane, and 2-amino-1,3-propanediol.

23. The method of claim 22 wherein the vehicle includes an internal combustion engine having a crankcase and wherein the lubricant composition comprises a crankcase oil present in the crankcase of the vehicle.

24. The method of claim 22 wherein the lubricant composition comprises a drive train lubricant present in an automotive drive train of the vehicle.

25. The method of claim 22, wherein the reaction product includes an untreated amine selected from the group consisting of aliphatic and aromatic amines.

26. The method of claim 22, wherein the lubricant additive includes a composition selected from the group consisting of hydrocarbyl succinic anhydrides reacted with amines, Mannich adducts derived from hydrocarbyl-substituted phenols reacted with formaldehydes and amines, ethylene-propylene copolymers grafted with ethylenically unsaturated carboxylic groups reacted with amines, copolymers of unsaturated acids and polyolefins reacted with amines, and acid or ester functionalized hydrocarbon polymers reacted with amines, wherein the amines comprise untreated aliphatic or aromatic amines.

27. The method of claim 22, wherein the reaction product is a post treated reaction product.

28. A method for lubricating moving parts comprising contacting the moving parts with a lubricant composition containing a lubricant and a lubricant additive, the lubricant additive comprising a reaction product comprising Mannich adducts derived from hydrocarbyl-substituted phenols, formaldehydes and treated amines, wherein the reaction product is oil soluble and has a number average molecular weight ranging from about 900 to about 50,000 as determined by gel permeation chromatography, and wherein the treated amine comprises an aliphatic or aromatic amine containing at least one primary or secondary amino group reacted with acrylonitrile or homologue thereof, followed by reduction to the primary amine, with the proviso that the aliphatic amine is chosen from aminoguanidine bicarbonate; a mixture of amines comprising tetraethylene pentamine, pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the proviso that the aromatic amine is chosen from N-arylphenylenediamines; and with the further proviso that if the aliphatic or aromatic amine is a hydroxyamine, the hydroxyamine is chosen from oligomers, polymers, aminoethylethanolamine, aminopropyldiethanolamine, partially propoxylated hexamethylene diamine, 3-amino-1,2-propanediol, tris (hydroxymethyl)aminomethane, and 2-amino-1,3-propanediol.

29. The method of claim 28 wherein the lubricant composition comprises a gear lubricant present in a gear box.

30. The method of claim 28, wherein the reaction product includes an untreated amine selected from the group consisting of aliphatic and aromatic amines.

31. The method of claim 28, wherein the lubricant additive includes a composition selected from the group consisting of hydrocarbyl succinic anhydrides reacted with amines, Mannich adducts derived from hydrocarbyl-substituted phenols reacted with formaldehydes and amines, ethylene-propylene copolymers grafted with ethylenically unsaturated carboxylic groups reacted with amines, copolymers of unsaturated acids and polyolefins reacted with amines, and acid or ester functionalized hydrocarbon polymers reacted with amines, wherein the amines comprise untreated aliphatic or aromatic amines.

32. The method of claim 28, wherein the reaction product is a post treated reaction product.

33. A method for decreasing combustion chamber deposits and/or intake valve deposits in an engine comprising providing a fuel containing an additive comprising Mannich adducts derived from hydrocarbyl-substituted phenols reacted with formaldehydes and amines, wherein the amines comprise treated aliphatic or aromatic amines, wherein the treated amines comprise an aliphatic or aromatic amine containing at least one primary or secondary amino group reacted with acrylonitrile or homologue thereof, followed by reduction to the primary amine, with the proviso that the aliphatic amine is chosen from aminoguanidine bicarbonate; a mixture of amines comprising tetraethylene pentamine, and pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the proviso that the aromatic amine is chosen from N-arylphenylenediamines; and with the further proviso that if the aliphatic or aromatic amine is a hydroxyamine, the hydroxyamine is chosen from oligomers, polymers, aminoethylethanolamine, aminopropyldiethanolamine, partially propoxylated hexamethylene diamine, 3-amino-1,2-propanediol, tris (hydroxymethyl)aminomethane, and 2-amino-1,3-propanediol.

34. The method of claim 33, wherein the reaction product is a post treated reaction product.

35. The lubricating composition of claim 7, wherein the composition has a sulfur content of less than 0.5 weight percent, a phosphorus content of less than 0.11 weight percent, and a sulfated ash content of less than 1.2 weight percent.

36. A composition for use as an additive for fuels or lubricants comprising a reaction product comprising Mannich adducts derived from hydrocarbyl-substituted phenols, formaldehydes and treated amines, wherein the reaction product is oil soluble and has a number average molecular weight ranging from about 900 to about 50,000 as determined by gel permeation chromatography, and wherein the treated amine comprises an aliphatic or aromatic amine containing at least one primary or secondary amino group reacted with acrylonitrile or at least one homologue thereof, followed by reduction to the primary amine, with the proviso that the aliphatic amine is chosen from anioguanidine bicarbonate; a mixture of amines comprising tetraethylene pentamine, pentaethylene hexamine, hexaethylene heptamine, and compounds having the structure $H_2NCH_2CH_2(NHCH_2CH_2)_xNH_2$, wherein x is 3 or higher; heavy polyamines; and hydroxyamines, with the further proviso that if the aliphatic amine is a hydroxylamine, the hydroxylamine is chosen from oligomers, polymers, aminoethylethanolamine, aminopropyldiethanolamine, partially propoxylated hexamethylene diamine, 3-amino-1,2-propanediol, tris (hydroxymethyl)aminomethane, and 2-amino-1,3-propanediol.

37. The composition of claim 36, wherein the reaction product comprises a hydrocarbyl-substituted succinimide derived from the treated amine and a hydrocarbyl-substituted succinic acid having a mole ratio of succinic aid to treated amine ranging from about 0.3:1.0 to about 12.0:1.

38. The composition of claim 1, wherein the reaction product comprises Mannich adducts derived from hydrocarbyl-substituted phenols, formaldehydes and treated amines.

* * * * *